US012139990B2

(12) United States Patent
Stoesser et al.

(10) Patent No.: US 12,139,990 B2
(45) Date of Patent: Nov. 12, 2024

(54) DUAL STRING HANGER ASSEMBLY

(71) Applicant: EVOLUTION OIL TOOLS INC., Calgary (CA)

(72) Inventors: Emery Stoesser, Calgary (CA); Vern Hult, Calgary (CA)

(73) Assignee: EVOLUTION OIL TOOLS INC., Calgary (CA)

( * ) Notice: Subject to any disclaimer, the term of this patent is extended or adjusted under 35 U.S.C. 154(b) by 0 days.

(21) Appl. No.: 17/686,212

(22) Filed: Mar. 3, 2022

(65) Prior Publication Data

US 2022/0282589 A1 Sep. 8, 2022

Related U.S. Application Data

(60) Provisional application No. 63/155,834, filed on Mar. 3, 2021.

(51) Int. Cl.
*E21B 33/047* (2006.01)
*E21B 33/04* (2006.01)

(52) U.S. Cl.
CPC ..... *E21B 33/047* (2013.01); *E21B 33/04* (2013.01)

(58) Field of Classification Search
CPC ..... E21B 33/04; E21B 33/047
See application file for complete search history.

(56) References Cited

U.S. PATENT DOCUMENTS 5,794,693 A * 8/1998 Wright ..... E21B 33/047 166/85.5
2018/0223621 A1* 8/2018 McGuire ..... E21B 33/068

* cited by examiner

*Primary Examiner* — Blake Michener
*Assistant Examiner* — Yanick A Akaragwe
(74) *Attorney, Agent, or Firm* — Bennett Jones LLP

(57) ABSTRACT

The dual string hanger assembly includes an insert and an adaptor. The insert is installed within the inner diameter of the tubing head and the adaptor is coupled over the top of the tubing head. The insert therefore becomes sealed within the interior space between the tubing head and the adaptor. In use, the production string is supported in a tubing hanger profile built into the adaptor above the existing tubing head. The auxiliary line is supported in a second, smaller diameter hanger profile that is on the insert, which is installed within the tubing head. The assembly may include a hanging apparatus, such as slips, to secure the auxiliary line in the hanger profile of the insert.

8 Claims, 4 Drawing Sheets

DUAL STRING HANGER ASSEMBLY

FIELD OF THE INVENTION

This invention relates to an apparatus for hanging a production tubing string and an auxiliary tubing string within a well casing.

BACKGROUND OF THE INVENTION

Many production oil wells are "dual string" wells, meaning that they include a production tubing string and an auxiliary tubing string located within the well casing.

The production tubing string serves to support the pump and sucker rods and provides a means to extract oil. The production tubing string is often rotated through a variety of different means or methods, such as a tubing rotator, in order to more evenly distribute wear on its inside surface due to contact with the sucker rods. Often, the production tubing is landed in the heel of the well.

The auxiliary tubing string in some instances is coil tubing. The coil tubing may act as another production string, where for example, two production tubing strings are for production from different zones in the well. Alternately, the coil tubing string operates to support a fluid supply or power or control lines. In one embodiment, for example, the coil tubing string is a flushing tube. In some operations, the auxiliary tube runs inside the casing, all the way to the toe of the well. In wells that include a liner, the auxiliary tube runs through the liner as well. Produced water may be recirculated through the auxiliary tube down to the toe to maintain fluid flow at enough velocity to keep the horizontal section clean. The auxiliary tube remains in the well during long periods of its producing life. The coil size is generally as large in diameter as possible for maximum circulation and fluid flow effectiveness. For example, 1¾" coiled tubing can be fitted into a 7" casing along with a 3½ inch production tubing.

Although such dual string wells have proven to be effective in many cases, the use of currently known apparatus and methods of configuring a dual string well with coil tubing often result in operational difficulties and high costs. For example, coil tubing is difficult to handle and difficult to bend around sharp radiuses and therefore is difficult to install. In addition, existing dual string hangers are typically installed in the tubing head and service operations on the production tubing necessitates removing the coiled tubing as well. This adds a coiled tubing service rig to the operation so service operations take longer and are more expensive relative to a well equipped with a single production tubing string. Accordingly, when it becomes necessary to remove either the auxiliary string, or the production tubing string, a number of structures must be removed simultaneously from the well casing. If one string is pulled out or run in while the other remains in place, the two strings tend to get caught up with each other. The coil tubing, for example, can get caught on the coupling (i.e. larger diameter) connections of the production tubing. Thus, well maintenance in dual string installations can be time and labour intensive and very costly. Furthermore, existing dual string hanging devices often have no means for providing well control using the service rig BOP during installation or removal. Instead, kill fluids are added to the well to control the well pressure. However, gas may circulate up through the kill fluid at a velocity capable of lifting the kill fluid inside of the well casing and can result in an oil spill or possible blow out.

SUMMARY OF THE INVENTION

The invention therefore provides a dual string tubing hanger assembly for production tubing and an auxiliary line.

In accordance with one broad aspect of the invention, there is provided an apparatus for hanging a production tubing string and an auxiliary line within a well casing having a wellhead including a tubing head, the apparatus comprising: an insert with a body configured to be secured in the tubing head, an auxiliary line hanging profile extending from top to bottom through the body, the auxiliary line hanging profile being positioned non-concentrically relative to an outer diameter of the body; and an adaptor installable on top of the tubing head, the adapter including: an outer surface and an interior open area extending from an upper end to a lower end, the lower end defining an annular mounting flange; a production string tubing hanger bowl in the interior open area configured for accommodating the production tubing string suspended therein, the production string tubing hanger bowl being spaced above the annular mounting flange, with a center axis non-concentrically positioned relative to the annular mounting flange and defining therebelow a tubing string accommodating area that is positioned non-concentric relative to the annular mounting flange and a crescent shaped area opposite the tubing string accommodating area; and a port for auxiliary line fluid communication, the port extending from the outer surface to an inner opening in the crescent-shaped area in a position alignable over the auxiliary line hanging profile.

In accordance with another broad aspect of the invention, there is provided a wellhead installation comprising: a tubing head on a well casing; an insert secured in the tubing head, an auxiliary line hanging profile extending from top to bottom through the body and the auxiliary line hanging profile being positioned non-concentrically relative to an outer diameter of the body; an adaptor for hanging a production tubing string within the well casing, the adaptor including: a main body with an outer surface and an interior open area extending from an upper end to a lower end, the lower end defining an annular mounting flange through which the adaptor is mounted on the tubing head; a production string tubing hanger profile in the interior open area, the production string tubing hanger profile being offset non-concentrically relative to the annular mounting flange; and a port for auxiliary line fluid communication, the port extending from the outer surface to an inner opening and positioned alignable over the auxiliary line hanging profile; a tubing string suspended in the production string tubing hanger profile and hanging down in a position non-concentric relative to the annular mounting flange; and an auxiliary line suspended from the auxiliary line hanging profile and in fluid communication with the port.

In accordance with another broad aspect of the invention, there is provided a method for wellbore operations, the method comprising: hanging an auxiliary line from an insert installed in a tubing head of a well; hanging a tubing string from an tubing hanger profile spaced above the tubing head, the tubing string extending down through tubing head and the insert and extending alongside the auxiliary line; configuring the auxiliary line to be connectable into fluid communication with an exterior source of fluid and sealed from fluid communication with tubing head and the tubing string; and removing the tubing string while the auxiliary line remains hung from the insert and remains sealed from fluid communication with tubing head and the tubing string

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF EMBODIMENTS

Figure 1:
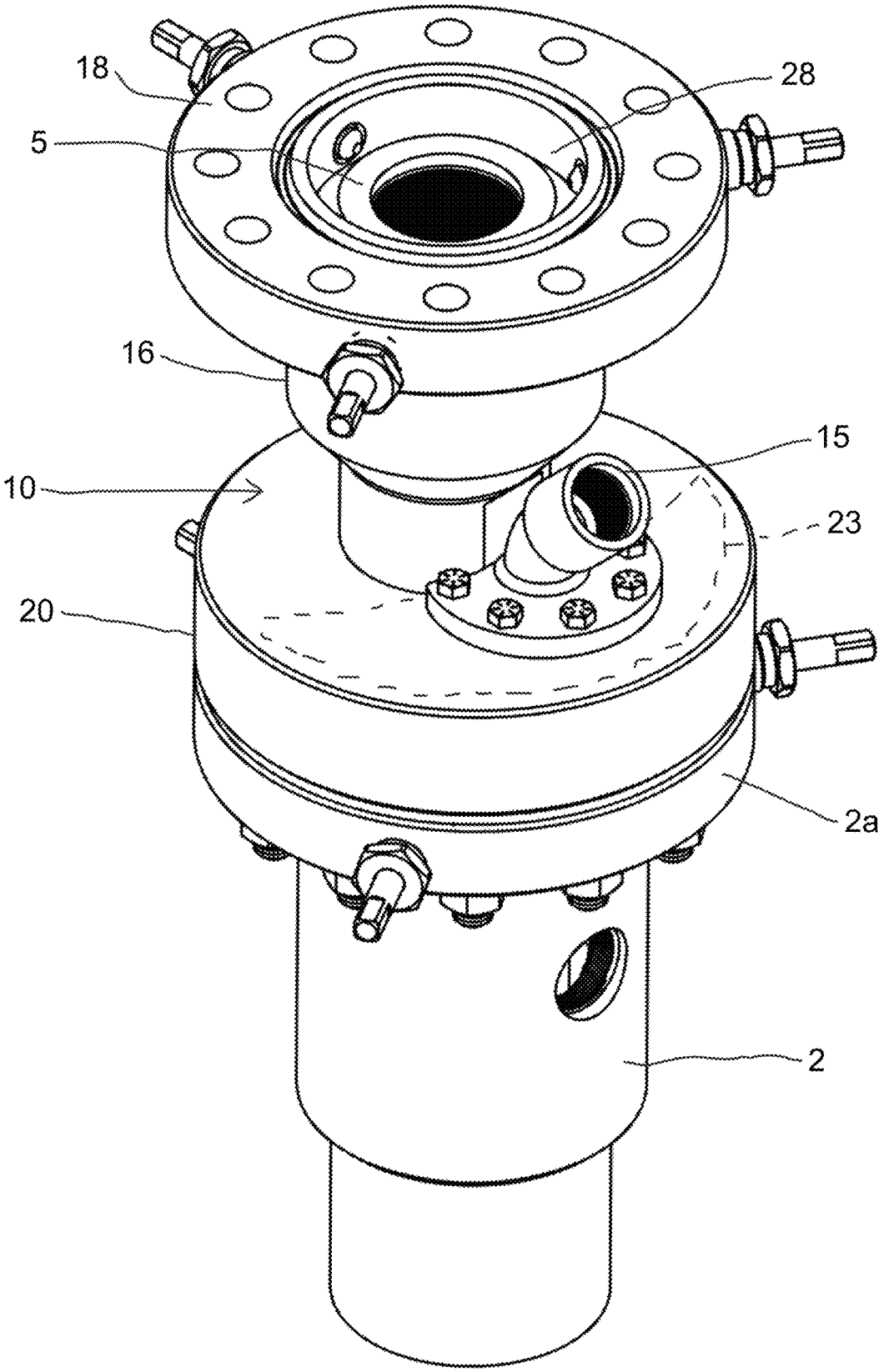
FIG. 1 is an isometric view of an adapter of a dual string hanger assembly installed on a tubing head.

The present dual string hanger assembly is configured for coupling to a tubing head of a wellhead and supporting two strings in a well. The two strings are a production string and an auxiliary string. The auxiliary line may be coiled tubing as shown or other, such as conventional, smaller diameter tubing. The auxiliary line is sometimes called a flushing line.

The dual string hanger assembly includes an insert and an adaptor. The insert is installed within the inner diameter of the tubing head and the adaptor is coupled over the top of the tubing head. The insert therefore becomes sealed within the interior space between the tubing head and the adaptor.

In use, the production string is supported in a tubing hanger profile built into the adaptor above the existing tubing head. The auxiliary line is supported in a second, smaller diameter hanger profile that is on the insert, which is installed within the tubing head. The assembly may include a hanging apparatus, such as slips, to secure the auxiliary line in the hanger profile of the insert.

The present dual string hanger assembly offers several key attributes, including at least:

1. The production string and the auxiliary string, such as coiled tubing, are supported and oriented with sufficient spacing therebetween to avoid interference between them.

2. The production string can be pulled without disturbing the auxiliary line. In other words, the auxiliary line can stay in place while the production string is removed, serviced and run back in. This is useful because the production string is serviced more often than the auxiliary string.

3. The auxiliary string is sealed to the dual string adaptor so it can stay in place and remain isolated from the production string and from the annulus between the production string and the casing during production string servicing operations.

4. Because the second, smaller diameter hanger profile, and thereby the connection between the hanger profile, hanging apparatus and the auxiliary line, is positioned within the inner diameter of the tubing head and within the interior space, no seals are required at the hanging profile and hanging apparatus for the auxiliary line.

5. No special purpose tubing rotator is required, as the dual string adaptor can be configured to accommodate various rotators at the production string hanger.

6. No special wellhead is required.

An embodiment of a dual string tubing hanger assembly is described with reference to FIGS. 1 to 4. The dual string tubing hanger assembly includes an adapter 10 that is installed on an existing tubing head 2 and an insert 12 that is installed within the tubing head 2. Insert 12 is configured to support the small diameter auxiliary tubing and the adapter is configured to support the production tubing in a dual string well. In particular, there is a hanging profile on each of the adapter 10 and the insert 12. Each hanging profile includes a bore in which its string is supported. Each hanging profile includes a shoulder, ledge and/or securing apparatus to support its string.

The adapter 10, when installed on the top of the tubing head, creates a sealed interior space between the interior of the tubing head and the underside of the adapter. The insert is contained within the interior space.

In particular, insert 12 is employed that is configured to be hung in the existing tubing head 2. Insert 12, for example, has an annular outer wall configured for hanging in the tubing head. For example, the annular outer wall may have a radially outwardly projecting shoulder such as, a frustoconical, downwardly tapering outer diameter surface 12' shape that is sized to be hung in the frustoconical, downwardly tapering bowel 2*b* of the tubing head.

The insert includes a hanging profile 12*a* for the auxiliary line. In particular, the insert includes a support portion 21 protruding from an inner diameter surface of the annular outer wall. The support portion protrudes into the inner area on one side of the insert. From FIG. 4, it can be seen for example, that the support portion 12 may accommodate a crescent shaped portion of the inner diameter across the outer wall of the insert. The support portion defines the hanging profile 12*a*. The hanging profile is a bore that extends from an upper surface to a lower surface on the support portion of the insert. The hanging profile 12*a* is positioned off center, non-concentric relative to the outer diameter of the insert outer wall. The hanging profile is close to the outer diameter surface. The insert supports the auxiliary line 4. In particular, the auxiliary line passes through and is supported near its upper end in the hanging profile 12*a* of the insert. The auxiliary line 4 hangs straight down below insert 12.

The dual string hanger assembly can include a mechanical hanging apparatus 13 for securing the auxiliary line on the insert. In one embodiment, the hanging profile 12*a* has a slight downward taper and mechanical hanging apparatus 13 is for example a slip assembly that fits between the bore wall defining the hanging profile and the string 4. In such an embodiment, auxiliary line 4 is mechanically supported by the insert and can be landed under tension using hanging apparatus 13 slip means that can be actuated by applying force to the top of the slips.

There is a large open area 12*b* on the insert 12 encircled in part by the outer wall of the insert. The large open area is positioned diametrically opposite the support area 21 and hanging profile 12*a*.

Adapter 10 is installed on top of the tubing head 2 above the insert 12. The installation seals flange 20*a* to flange 2*a* of the tubing head. Auxiliary line 4 is installed in insert 12 prior to installing the adaptor. After installation of the adapter 10, the insert 12 and hanging apparatus 13 are protected within the internal area common between adapter 10 and tubing head 2. In other words, insert 12 in use, is installed within the inner diameter of the tubing head and below the underside of adapter, which is a sealed area.

The adapter includes a port 15 through which fluid communication is made to the auxiliary line. In particular, adapter 10 has an exterior wall and port 15 extends through the wall. Port 15 is positioned on the adapter such that when the adapter is installed above the insert, port 15 can be installed in substantially vertical alignment over the small diameter hanging profile 12*a* of insert 12. For example, port 15 is positioned off-center, non-concentric relative to the outer diameter of the flange 20*a*, such that it is positioned to be alignable above hanging profile 12*a*.

The dual tubing string assembly includes seals 17 for sealing auxiliary line 4 into communication with the flow communication port 15. Seals 17 may be carried, for example, in glands on the inner diameter of port 15. For example, seals may be installed in glands on the inner diameter of a collar that fits into a hole in the adaptor wall and defines port 15. Thus, an end of auxiliary line 4, or an extension therefor, can be inserted and sealed into the flow communication port 15. The port 15 may be defined as the conduit through a threaded connection, pipe elbow, etc. coupled to the adapter. The port may have an end configured, such as by threading or having a quick lock detent, for receiving connection of external piping, etc., for communication to auxiliary line. The port may be integral with adaptor 10 or coupled thereto (as shown). Auxiliary line 4, therefore, is directly or indirectly coupled to the lower flange 20*a* of the adaptor and sealed by sealing means 17 to be isolated from annular pressure, but able to receive fluid communication and flow through port 15 from outside fluid supplies.

In the illustrated embodiment port 15 is defined by a lower collar and an aligned pipe both installed in the adapter wall. The collar and pipe are installed to vertically align above the hanging profile 12*a* such that the auxiliary line can extend straight up into connection with the collar. As such, the auxiliary line 4 need not be forced into bent configuration. The auxiliary line telescopically slides into and is sealed by seals 17 within a lower opening to the collar inner diameter. The pipe is installed above the collar in communication with the collar inner diameter. An elbow in the pipe external to the adapter wall facilitates connections to external lines. In particular, the elbow bends the pipe radially outwardly from the position where the pipe emerges from the adapter wall.

The production string 5 is supported in the dual string adaptor 10 by a hanging profile 28 that is elevated above the insert 12 auxiliary line hanging profile 12*a*. The production string is larger diameter than the auxiliary string, so the production string hanging profile 28 is a larger diameter than the auxiliary string hanging profile. The hanging profile 28 is positioned non-concentric, off center relative to flange 20*a*, which is also off center relative to the tubing head 2 and casing 6. Production string 5 hangs down from hanging profile 28, through the adapter and tubing head 2 and into the casing. Insert 12 does not affect passage of string 5 through head 2. In particular, bore 12*b* in insert 12 is aligned below profile 28 and bore 12*b* is large enough to allow string 5 to pass. The production tubing is not in any way supported by or directly coupled to, the insert.

The current embodiment, allows 3½" production tubing and 1¾" auxiliary line all within a 7" casing and tubing head. The production string can be pulled without disturbing the auxiliary line. In other words, the auxiliary line can stay in place while the production string is removed, serviced and run back in. Once the auxiliary line is in place, it can be accessed by removing the production tubing 5 and dual string adaptor 10. As such, this dual string hanger semi-permanently hangs the auxiliary line 4, but permits the production string 5 to be pulled when required to fix holes in tubing, replace the pump, etc.

This is achieved by having a production tubing hanging profile separate from that for the auxiliary line. Also, the production string hanger 28 is spaced above the existing tubing head 2 and above the auxiliary line hanger 12*a*.

The dual string hanger assembly can, but does not necessarily, use a tubing rotator. The rotator is a separate function added by putting a rotating tubing hanger into the adaptor hanging profile 28 and then bolting a rotator drive on top of the adaptor 10 or alternately, adding an independent tubing rotator to the top flange of the adaptor. Prior systems use a very much larger tubing head, such as 11"×2K, in order to accommodate a large tubing hanger placed in the tubing hanger profile. That tubing hanger has a rotating hanger inserted into a large hole in the hanger body to allow the production tubing to be rotated by the rotator mechanism. The disadvantage of that approach is the substantial cost of the upsized tubing head, upsized tubing rotator body and the cost of renting rig BOPs each time the well has to be serviced.

Figure 2:
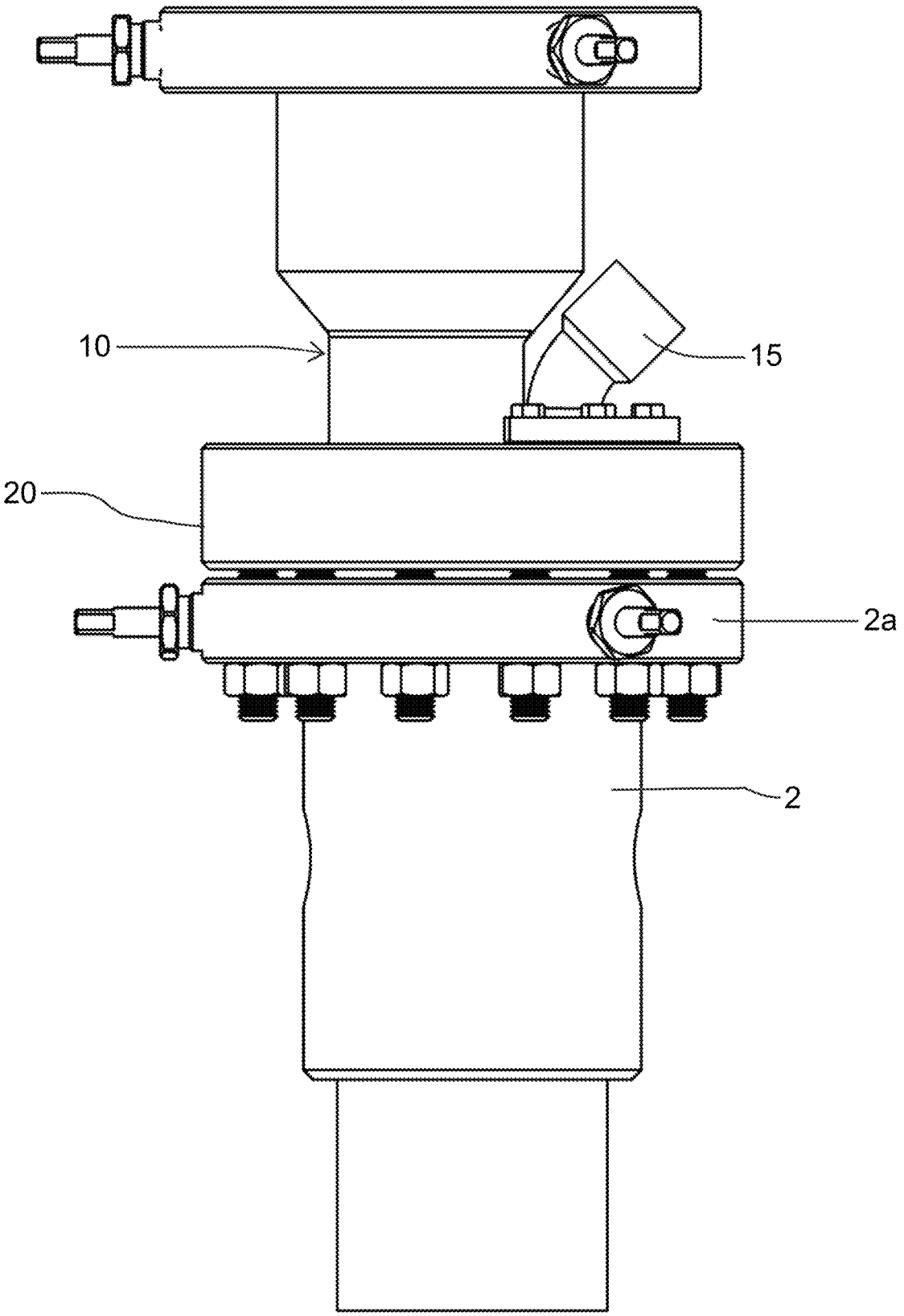
FIG. 2 is a side elevation of a wellhead assembly of FIG. 1.
Figure 3:
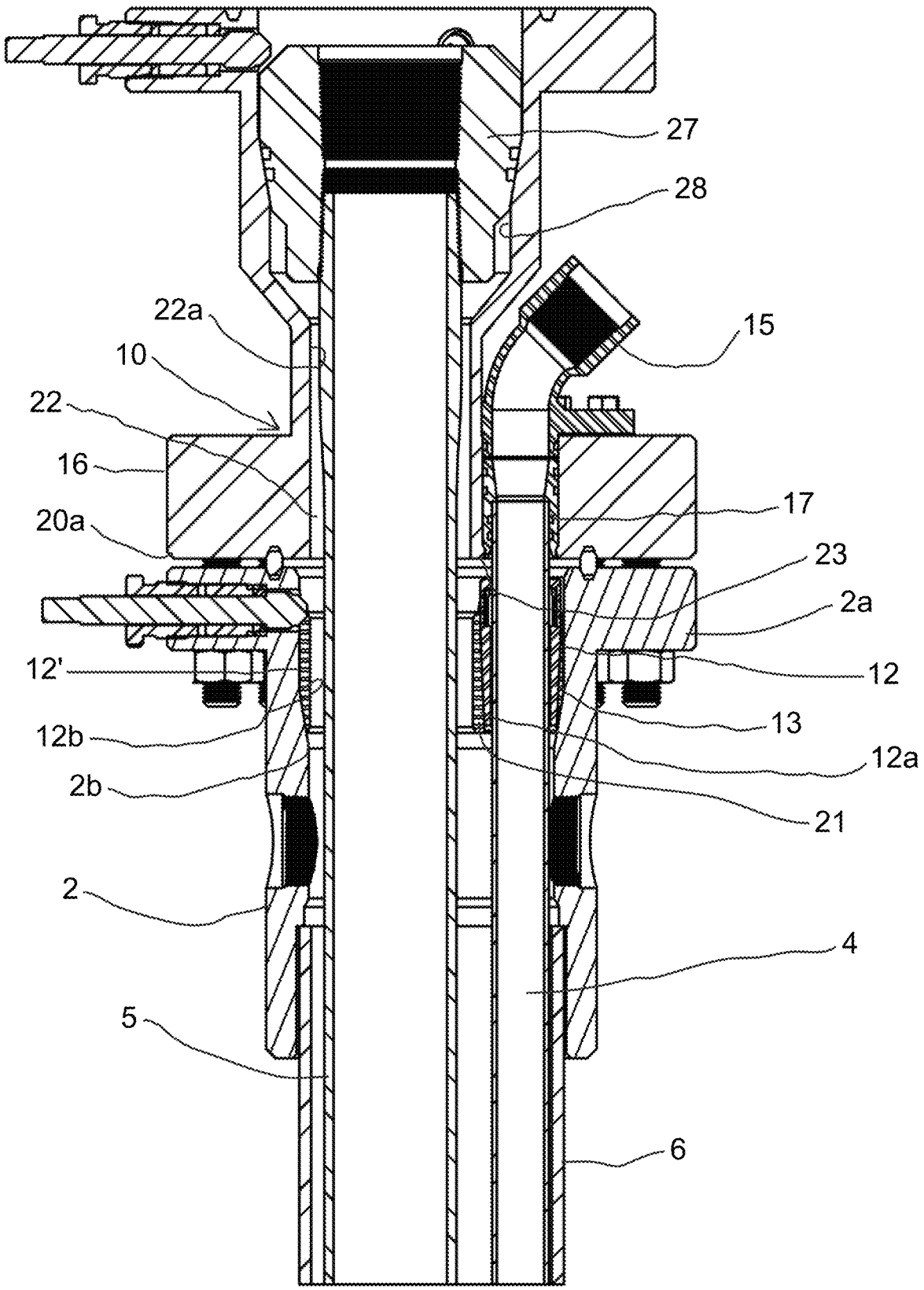
FIG. 3 is a section through the wellhead installation of FIG. 1, the section taken along the long axis of the coil tubing port.
Figure 4:
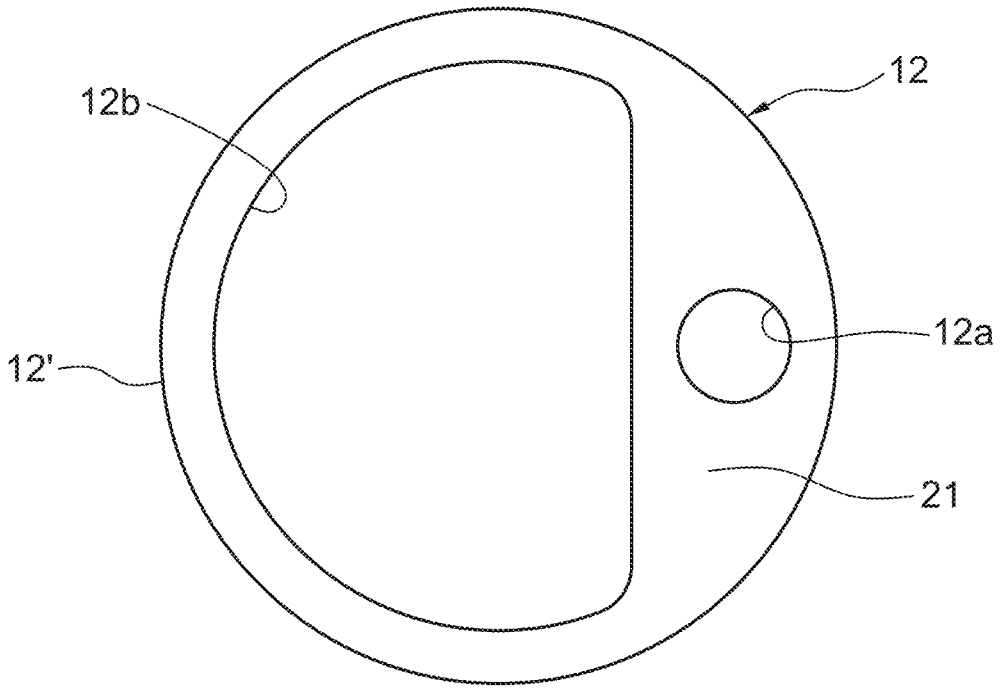
FIG. 4 is a schematic, top plan view of a tubing head insert useful in the invention.

Referring more closely to FIGS. 1 to 3, adaptor 10 is illustrated in a condition installed on a wellhead. Adaptor 10 includes a cylindrical body having an exterior surface 16, an upper end 18, a lower end 20, and an interior open area 22 extending between upper end 18 and lower end 20. Upper end 18 defines a first attachment flange or surface. Lower end 20 defines the lower attachment flange 20*a* or mounting surface for the adaptor. As will be appreciated, attachment flanges are generally annular planar surfaces with holes for receiving bolts to attach to similarly shaped annular planar faces on other parts.

When in use, upper end 18 may optionally support and be connected to further wellhead equipment such as a blowout preventor or tubing rotator and lower end 20 is rigidly attached, directly or indirectly, to a flange 2*a* of tubing head 2 coupled on the upper end of well casing 6.

Lower end 20 has its annular flange 20*a* encircling an opening that permits access to interior open area 22. Annular flange 20*a* is a planar circular surface. Interior open area 22 can take various forms.

Adaptor 10 is configured to support two strings. One string is tubing string 5 and the other is auxiliary line 4. Tubing string 5 is secured to the adaptor and is suspended to extend down from adaptor 10 and into casing 6.

There is an internal bowl 28, usually called a tubing hanger profile, spaced above the lower end 20, and for example, generally close to upper end 18 of the adaptor body. Internal bowl 28 is open to interior open area 22. A portion of interior open area extends vertically down from the bowl to the adapter's lower end. Tubing string 5 is suspended by means of an enlarged diameter tubing hanger 27 on its upper end from internal bowl 28 and tubing string 5 extends down through the bore toward and down past lower end 20. Internal bowl 28 is configured to support the tubing string 5. Internal bowl 28 may be positioned closer to one side of the circle defining the lower end-mounting flange 20*a*. As such, internal bowl 28 is located non-concentric relative to the circular shape of annular flange 20*a* at lower end 20. This suspends tubing string 5 offset closer to a side of the planar expanse of lower end 20 rather than hanging centrally therethrough. Thus, an area on the side of the adaptor interior area accommodates tubing string 5 hanging therein. That area extends directly below internal bowl 28 through and, vertically aligned below, bore 22*a*. As such, the area accommodating tubing string 5 is also non-concentric relative to the lower end-mounting flange 20*a*. This creates an open crescent-shaped area 23 (shown in phantom in FIG. 1) relative to the circular mounting flange 20*a* on lower end 20 alongside bore 22*a*, which is the area where tubing string is accommodated. Internal bowl 28 may be integral with the rest of the adaptor or a structure connected to the rest of the adaptor.

The crescent-shaped area 23 is the portion on the lower end between the opening to the bore 22*a* below bowl 28 and annular flange 20*a*. The crescent-shaped area may be the entire bottom of the adaptor in plan view except that area below bowl 28.

Adaptor 10 also includes the auxiliary line communication port 15 that extends from an opening on exterior surface 16 to an inner opening in the crescent-shaped area 23 within the adaptor. Generally, port 15 opens adjacent lower end 20 in the crescent-shaped area 23.

In one embodiment, the tubing hanger bowl 28 being shifted as far off center as possible, the limitation is the couplings on the tubing 5 contacting the ID of the casing 6. With the production tubing shifted as far off center as possible, the crescent shape between the casing ID and the production tubing 5 OD is as large as possible and the coil is introduced into that crescent-shaped area 23.

In operation, the operator can install the insert 12 in tubing head 2 and secure the flush line upper end with the hanging apparatus 13 in profile 12*a*. The adapter 10 may then be installed on flange 2*a* to cover the insert. In so doing, the fluid connection of auxiliary line 4 to port 15 may be made up. Then, the production tubing 5 may be run in through the hanging profile, bore 22*a*, bore 12*b* and alongside auxiliary line 4.

While the lengths of tubing string 5 and auxiliary line 4 extend alongside each other through at least a portion of the well, the tubing string 5 is installed to extend along one side of the well while the auxiliary line extends along the other side.

The auxiliary line can extend down to the toe of the well. A continuous auxiliary flow can maintain the well free of sand and debris during production.

The dual tubing string hanging assembly may be configured to operate with any or all of a BOP, an auxiliary string hanger, a rotating hanger and a tubing rotator, as desired.

It is to be understood that what has been described are preferred embodiments of the invention and that it may be possible to make variations to these embodiments while staying within the broad scope of the invention. Some of these variations have been discussed while others will be readily apparent to those skilled in the art.

We claim:

1. An apparatus for hanging a production tubing string and an auxiliary line within a well casing having a wellhead including a tubing head, the apparatus comprising:

an insert with a body configured to be secured in the tubing head, an auxiliary line hanging profile extending from top to bottom through the body, the auxiliary line hanging profile being positioned non-concentrically relative to an outer diameter of the body and an opening extending from top to bottom through the body that is positioned diametrically opposite the auxiliary line hanging profile; and an adaptor installable on top of the tubing head, the adaptor including:

an outer surface and an interior open area extending from an upper end to a lower end, the lower end defining an annular mounting flange;

a production string tubing hanger bowl in the interior open area including an open upper end that is open to the outer surface and an inner diameter that tapers from the open upper end toward a smaller diameter lower end, the production string tubing hanger bowl for longitudinally supporting the production tubing string suspended therein, the production string tubing hanger bowl being spaced above the annular mounting flange, with a center axis non-concentrically positioned relative to the annular mounting flange and defining therebelow a tubing string accommodating area that is positioned non-concentric relative to the annular mounting flange and a crescent shaped area opposite the tubing string accommodating area; and a port for auxiliary line fluid communication, the port extending from the outer surface to an inner opening in the crescent-shaped area in a position alignable over the auxiliary line hanging profile, wherein the opening on the insert has a diameter larger than the smaller diameter lower end of the production string tubing hanger bowl such that the production tubing string while longitudinally supported in the production string tubing hanger bowl is not supported by, nor directly coupled to, the insert.

2. The assembly of claim 1, further comprising an auxiliary line hanging apparatus in the auxiliary line hanging profile.

3. The assembly of claim 1 further comprising a production tubing bore in the insert alongside but spaced from the auxiliary line hanging profile.

4. The assembly of claim 1, further comprising seals in the port for sealing against an outer diameter of an upper end of the auxiliary line.

5. A wellhead installation comprising:

a tubing head on a well casing;

an insert with a body secured in the tubing head, an auxiliary line hanging profile extending from top to bottom through the body and the auxiliary line hanging profile being positioned non-concentrically relative to an outer diameter of the body;

an adaptor for hanging a production tubing string within the well casing, the adaptor including:

a main body with an outer surface and an interior open area extending from an upper end to a lower end, the lower end defining an annular mounting flange through which the adaptor is mounted on the tubing head;

a production string tubing hanger profile in the interior open area, the production string tubing hanger profile being offset non-concentrically relative to the annular mounting flange; and a port for auxiliary line fluid communication, the port extending from the outer surface to an inner opening and positioned alignable over the auxiliary line hanging profile;

a tubing string longitudinally suspended from the production string tubing hanger profile and hanging down in a position non-concentric relative to the annular mounting flange without any support by, nor direct coupling to, the insert; and an auxiliary line suspended from the auxiliary line hanging profile and in fluid communication with the port.

6. The wellhead installation of claim 5, further comprising an opening in the insert, the tubing string extending down through the opening without contact with the insert.

7. The wellhead installation of claim 5, further comprising an auxiliary line hanging apparatus between the auxiliary line and the auxiliary line hanging profile.

8. A method for wellbore operations, the method comprising:

hanging an auxiliary line from an insert installed in a tubing head of a well;

hanging a tubing string for longitudinal support from a tubing hanger profile spaced above the tubing head, the tubing string extending down through the tubing head and the insert and extending down into the well alongside the auxiliary line, wherein during hanging of the tubing string, the tubing string is run in through an opening in the insert and the tubing string extends through the opening without any support by the insert;

configuring the auxiliary line to be connectable into fluid communication with an exterior source of fluid and sealed from fluid communication with tubing head and the tubing string; and removing the tubing string while the auxiliary line remains hung from the insert and remains sealed from fluid communication with the tubing head and the tubing string.

* * * * *